US007578093B2

(12) United States Patent
Marocco

(10) Patent No.: US 7,578,093 B2
(45) Date of Patent: Aug. 25, 2009

(54) SHUTTER WITH MULTI-PART TILT CONTROL BAR CONNECTOR

(76) Inventor: Mario M Marocco, 240 Bartor Road, Toronto, Ontario (CA) M9M 2W6

( * ) Notice: Subject to any disclaimer, the term of this patent is extended or adjusted under 35 U.S.C. 154(b) by 0 days.

(21) Appl. No.: 11/984,203

(22) Filed: Nov. 14, 2007

(65) Prior Publication Data

US 2009/0120000 A1 May 14, 2009

(51) Int. Cl.
*E06B 7/086* (2006.01)

(52) U.S. Cl. ..... 49/87.1

(58) Field of Classification Search ..... 49/74.1, 49/77.1, 87.1, 73.1

See application file for complete search history.

(56) References Cited

U.S. PATENT DOCUMENTS

| | | | | | |
|---|---|---|---|---|---|
| 164,431 | A * | 6/1875 | Duffy | 49/86.1 |
| 164,464 | A * | 6/1875 | Lanphere | 49/77.1 |
| 177,277 | A * | 5/1876 | Rathknecht | 49/77.1 |
| 227,937 | A * | 5/1880 | Wile | 49/87.1 |
| 284,222 | A * | 9/1883 | Nelson | 49/77.1 |
| 301,453 | A * | 7/1884 | Martin | 49/77.1 |
| 1,006,149 | A * | 10/1911 | Thompson | 49/77.1 |
| 2,331,758 | A * | 10/1943 | Barnett | 49/101 |
| 3,267,962 | A * | 8/1966 | Josephson et al. | 137/601.11 |
| 3,447,443 | A * | 6/1969 | Silvey | 454/335 |
| 4,241,539 | A * | 12/1980 | Josephson | 49/91.1 |
| 5,187,896 | A * | 2/1993 | Ross | 49/74.1 |
| 5,303,507 | A * | 4/1994 | Oille | 49/74.1 |
| 5,548,925 | A * | 8/1996 | Marocco | 49/74.1 |
| 5,778,598 | A * | 7/1998 | Ohanesian | 49/74.1 |
| 6,041,547 | A * | 3/2000 | Marocco | 49/87.1 |
| 6,250,012 | B1 * | 6/2001 | Ricci | 49/87.1 |
| 6,418,665 | B1 * | 7/2002 | Gabriele | 49/87.1 |
| 7,377,074 | B2 * | 5/2008 | Marocco | 49/87.1 |
| 2004/0025438 | A1 * | 2/2004 | Marocco | 49/87.1 |

* cited by examiner

*Primary Examiner*—Jerry Redman

(57) ABSTRACT

A shutter assembly having a rectangular frame and at least two separate sections of louvres rotatably supported in the frame; at least two separate tilt control bars, for controlling at least two separate groups of louvres; links connecting respective louvres to the respective control bar; a releasable connector device for connecting and disconnecting the tilt control bars of at least two separate sections of louvres of the shutter assembly, to allow adjustment of the tilt of the louvres in all groups of the shutter assembly in unison, or each separate group of the louvres individually.

11 Claims, 3 Drawing Sheets

SHUTTER WITH MULTI-PART TILT CONTROL BAR CONNECTOR

FIELD OF THE INVENTION

The present invention relates to the field of louvres for windows and doorways. More particularly, the present invention relates to a shutter assembly that can have several separate groups of louvres. The groups of louvres in the assembly can be operated by tilt control bars either individually, or all groups in unison.

BACKGROUND OF THE INVENTION

A shutter assembly comprises a frame and a plurality of vertically spaced horizontal louvres that are rotatably adjustable. Generally, such shutter assemblies have a rectangular frame comprised of vertically and horizontally spaced side rails. The vertical side rails have a plurality of horizontal louvres rotatably mounted between them. The tilt of the louvres can be adjusted and rotated between a closed position, in which the louvres overlap, and an opened position, in which the louvres are spaced apart. The louvres are opened and closed in unison with one another by a tilt control bar attached to the front edges of the louvres by a link. The control bar keeps the louvres uniformly oriented and adjusts the louvres in unison. If a shutter assembly has several separate groups of louvres, each of the groups of louvres has an individual louvre tilt control bar that opens and closes all louvres in the group in unison. In such multi-group shutter construction, each group of louvres can be opened and closed individually by the tilt control bar of that group without affecting tilt of the louvres in other groups. Such a multi-group shutter assembly is shown in the U.S. Pat. No. 6,250,012 B1.

The use of the individual tilt control bar for each of the groups in a multi-group shutter assembly has a significant disadvantage. Thus, there is a need for a shutter assembly that includes a mechanism for adjusting tilt of all the louvres in the multi-group shutter assembly in unison, while alternatively allowing for individual tilt control of the groups of louvres in separate groups of multi-group assembly. This need may be addressed by providing a connector that connects and disconnects the tilt control bars of the separate groups of louvres. When the tilt control bars of the separate groups of louvres are connected together by a connector, the tilt of all groups of the louvres in a multi-group shutter assembly is adjusted in unison. When the tilt control bars of separate groups of louvres are disconnected, the tilt of each group of the louvres is adjusted separately from the other groups of louvres. Such a connector for a shutter assembly should have a clean, uncluttered appearance and should be a mechanism that is relatively simple to construct.

BRIEF SUMMARY OF THE INVENTION

The present invention provides a shutter assembly with a frame with at least two groups of louvres and at least two tilt control bars to adjust the tilt position of louvres in a multi-group shutter assembly either separately or in unison. More specifically, the present invention comprises a shutter assembly having a rectangular frame, at least two groups of louvres, tilt control bars for each group of louvres and a connector device that connects and disconnects the tilt control bars of separate groups of louvres. When the tilt control bars of individual groups of louvres are disconnected, the tilt of each group of the louvres is adjusted separately from the other groups of louvres. When the tilt control bars are connected together by the connector device, the tilt of all groups of the louvres in a multi-group shutter assembly is adjusted in unison.

Preferably the tilt control bar is attached to the front edge of each louvre via a link. Usefully, inside the tilt control bar are two rail receiving openings and two tubes that extend from the bottom end to the top end of the tilt control bar.

More particularly, the rail receiving openings of the tilt control bar receive the connector device. Usefully, the tubes of the tilt control bar house the push-pull pins which release the connector device.

Usefully, the connector device consists of a median dividing plate, two pairs of upper and lower rails and two upper and lower flexible tongues.

Each side of the dividing plate provides support for a pair of rails and a flexible tongue located between the rails.

Usefully, each of the two flexible tongues of the connector device has a cylindrical head. Preferably, Each cylindrical head has a ramp surface sloping approximately at about 45 degrees from the point that is closer to the dividing plate to the point that is further from the dividing plate.

Preferably, The connector device is removably seated in the rail receiving openings of one of the tilt control bars of the multi-group shutter assembly.

The two rails of the connector device can freely slide into the two rail receiving openings of the tilt control bar. To connect two different tilt control bars in a multi-group shutter assembly, the rails of the connector device are inserted in to the two rail receiving openings of the tilt control bar in the multi-group shutter assembly. The rails of the connector device are sliding in the rail receiving openings of the tilt control bar until the ramp surface of the cylindrical head of the flexible tongue reaches a notch and locks in it. The cylindrical head of the flexible tongue serves as a latch. A notch has a push-pull finger sited in the finger opening. The cylindrical head of the flexible tongue pushes the push-pull finger outward in the finger opening when the cylindrical head of the flexible tongue reaches a notch and locks in it. The cylindrical head of the flexible tongue serves as a latch.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

Figure 1:
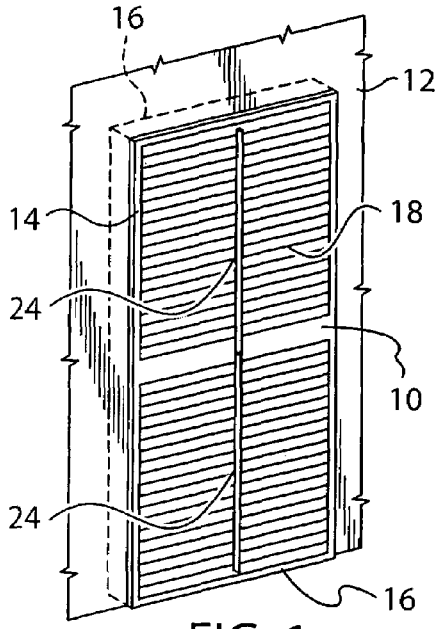
FIG. 1 is a perspective of a multi-group shutter assembly.
Figure 3:
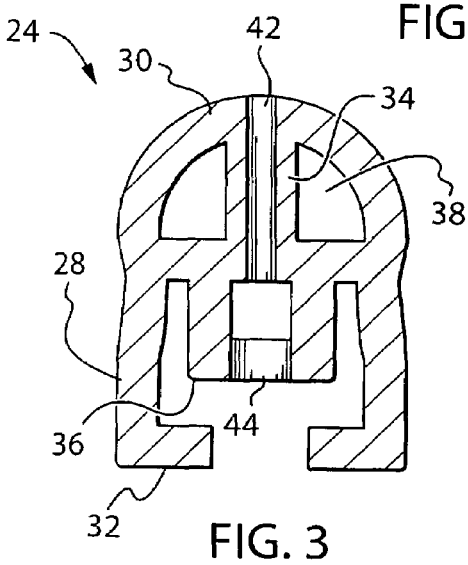
FIG. 3 is a horizontal cross section of the tilt control bar along line 3-3 of FIG. 2.
Figure 2:
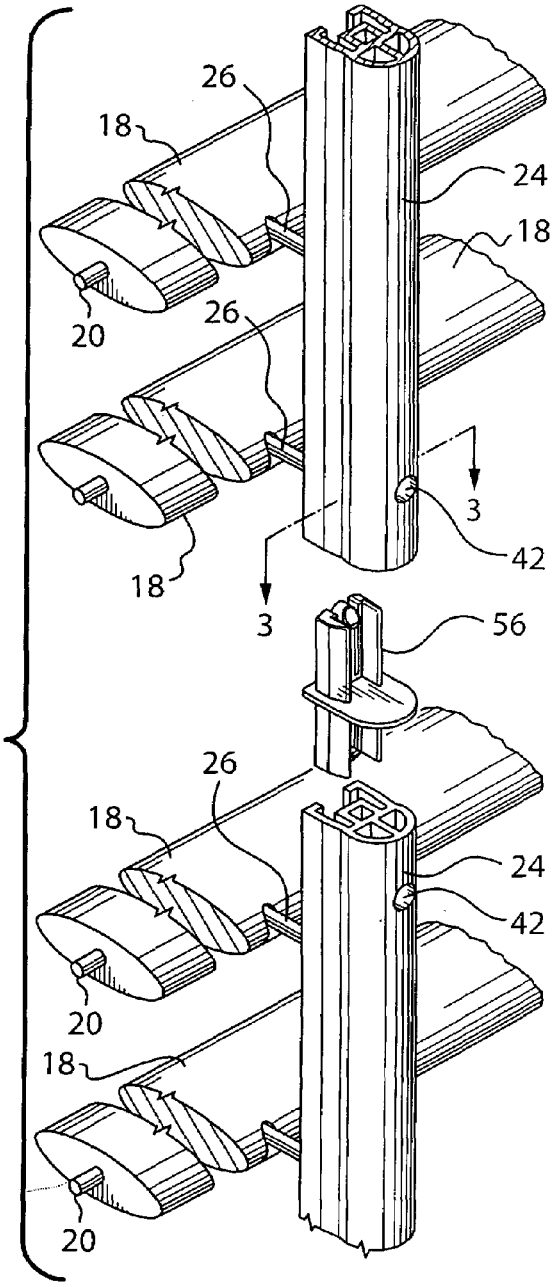
FIG. 2 is an exploded perspective of two control bars and a connector of the multi-group shutter assembly shown on the FIG. 1.
Figure 4:
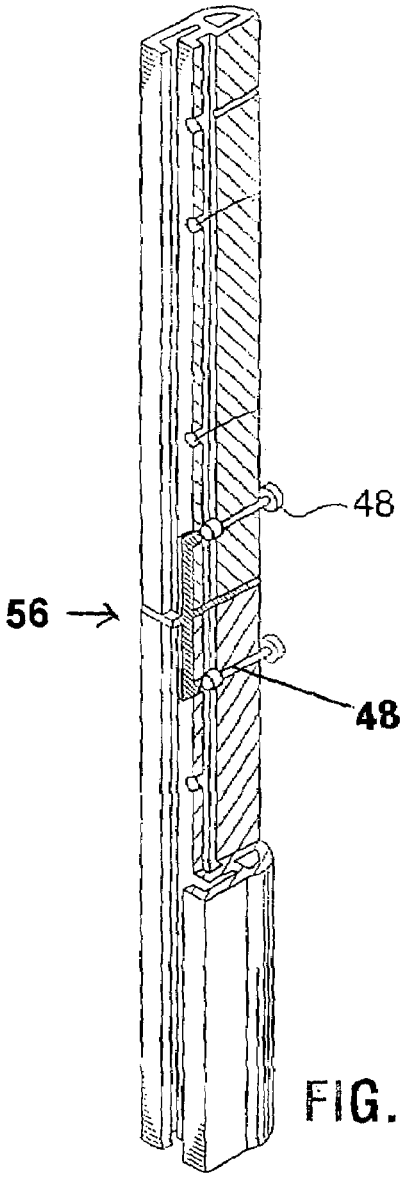
FIG. 4 is a perspective, partially cut away of two control bars.

A multi-group shutter assembly (10) shown on FIG. (1), in accordance with an embodiment of invention, is shown installed in a window frame (12). In the context of this patent description, the terms "shutter" and "blind" may be used interchangeably. Although the description which follows discloses the invention as installed in a window frame (12), it should be understood that the multi-group shutter assembly (10) with minor modifications can be installed in a doorway. The multi-group shutter assembly (10) has a rectangular frame comprised of a pair of vertically opposed side rails (14) and a pair of horizontally opposed side rails (16), as shown on FIG. 1. The multi-group shutter assembly (10) also includes a plurality of horizontal louvres (18) mounted between opposed vertical side rails (14). A louvre usually is formed of vinyl or plastic as shown on FIG. 2. Each louvre (18) has a pivot pin (20) on each end attached to the vertical side rails (14). The vertical side rails (14) include a plurality of louvre pivot pin openings (22). Each pivot pin opening (22) houses one pivot pin (20) of the louvre (18). The tilt of the louvres can be adjusted by the tilt control bar (24). The tilt control bar (24) is a bar made of material such as plastic, wood or aluminum. The tilt control bar (24) is attached to the front edge of each louvre in the group via a link (26) as shown on FIG. 2. The tilt control bar adjusts the tilt of all the louvres in the same group in unison. The tilt of the louvres (18) may be adjusted between an open position, in which adjacent louvres are vertically spaced apart, and a closed position, in which adjacent louvres are vertically overlapping.

Tilt Control Bar

The tilt control bar (24) is shown in FIGS. 2, 3, 4 and 6. The present invention employs a tilt control bar (24) construction that facilitates connection and disconnection of the individual tilt control bars (24) in a multi-group shutter assembly (10). The horizontal cross section of the tilt control bar (24) is shown on FIG. 3. The tilt control bar (24) has side walls (28). The side walls (28) are joined together by arcuate web (30). The side walls (28) have retention ribs (32). The retention ribs (32) extend from the side walls (28). The arcuate web (30) provides support to intermediate partition wall (34). The intermediate partition wall (34) is also supported by the z-shaped reinforcing walls (36). Z-shaped reinforcing walls (36) connect the intermediate partition wall (34) and the side walls (28). The intermediate partition wall (34) and z-shaped reinforcing walls (36) form hollow tubular spaces (38). The side walls (28), the z-shaped reinforcing walls (36) and the retention ribs (32) form the rail receiving openings (40). The rail receiving openings (40) extend from the bottom end to the top end of the tilt control bar (24).

Figure 6:
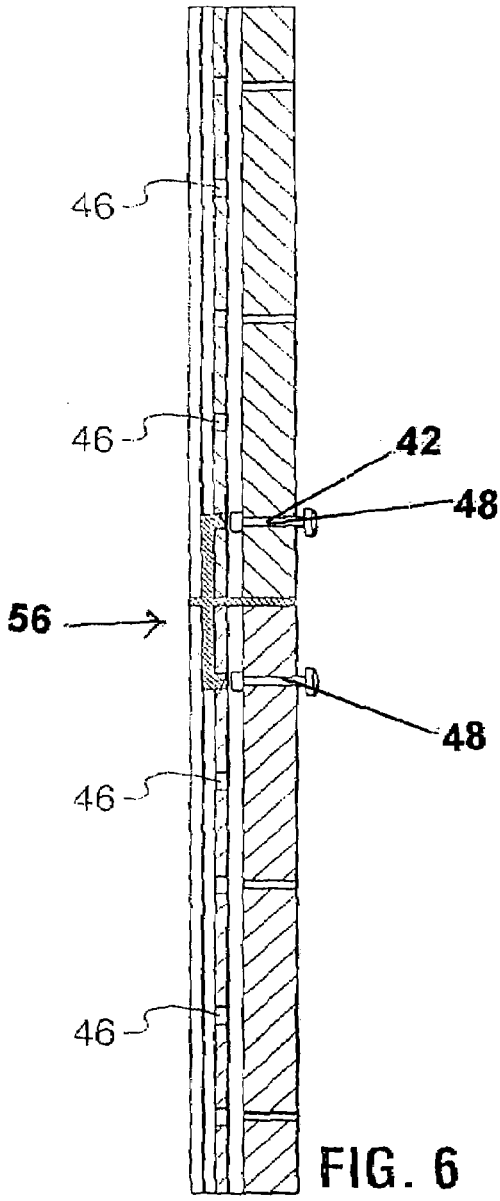
FIG. 6 is a vertical cross section of two control bars.

The vertical cross section of the tilt control bar (24) along the intermediate partition wall (34) is shown in the FIG. 6. The intermediate partition wall (34) extends from the bottom end to the top end of the tilt control bar (24). The intermediate partition wall (34) houses the finger opening (42). The finger opening (42) perforates the intermediate partition wall (34) through out from the end that is supported by the arcuate web (30) to the end that is supported by the z-shaped reinforcing walls (36). The diameter of the finger opening (42) is slightly increased on the end of the intermediate partition wall (34) that is supported by the z-shaped walls (36). This increase in diameter of the finger opening (42) forms the notch (44). The intermediate partition wall (34) also houses the sockets (46) for the links (26) that connect the tilt control bar (24) and the front edges of louvres (18).

Push-Pull Finger

Figure 5:
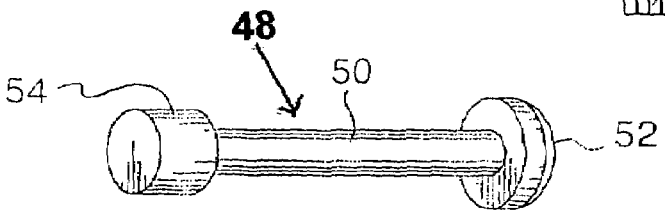
FIG. 5 is a perspective of a push-pull finger.

The push-pull finger (48) is shown on FIG. 5. The push-pull finger (48) has cylindrical shape. The push-pull finger (48) has a body (50). On the one end of the body (50) is a hemispheric head (52), on the other end of the body (50) is an enlargement (54). The diameter of the hemispheric head (52) and the diameter of the enlargement (54) are larger than the diameter of the body (50) of the push-pull finger (48). The diameter of the hemispheric head (52) and the diameter of the enlargement (54) are also larger than the diameter of finger opening (42) which houses the push-pull finger (48). The hemispheric head (52) of the push-pull finger (48) serves as a handle that allows pushing of the push-pull finger (48) inward through the finger opening (42). The diameter of the hemispheric head (52) of the push-pull finger (48) is slightly larger than the diameter of the body (50) of the push-pull finger (48). The diameter of the hemispheric head (52) is also slightly larger than the diameter of finger opening (42) in which the push-pull finger (48) is sitting. The hemispheric head (52) of the push-pull finger (48) does not allow the push-pull finger (48) to pass through the finger opening (42) beyond the hemispheric head (52) when the push-pull finger (48) is pushed inward the tilt control bar (24). The diameter of the enlargement (54) of the push-pull finger (48) is slightly larger than the diameter of the body (50) of push-pull finger (48). The diameter of the enlargement (54) is also slightly larger than the diameter of the finger opening (42) in which the push-pull finger (48) is sitting. The enlargement (54) of the push-pull finger (48) does not allow the push-pull finger (48) to pass through the finger opening (42) beyond the enlargement (54) when the push-pull finger (48) is pressed outward the tilt control bar (24).

Connector Device

Figure 7:
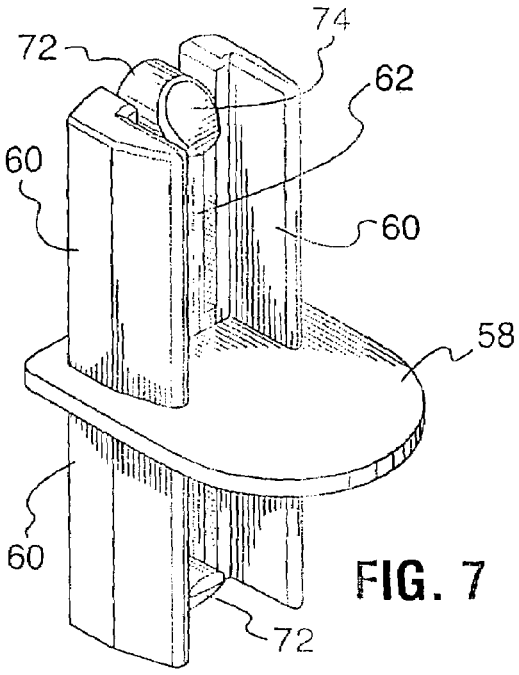
FIG. 7 is a perspective of the connector device.
Figure 9:
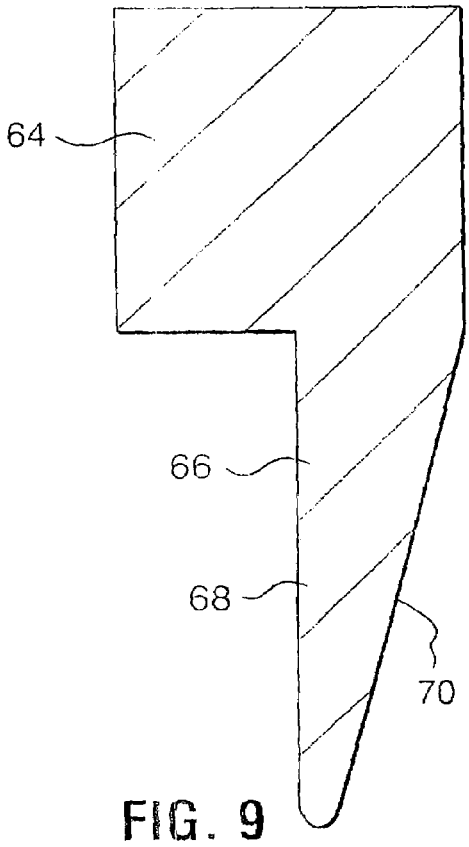
FIG. 9 is a section of the rail of the connector device shown on FIG. 8 and FIG. 9.
Figure 8:
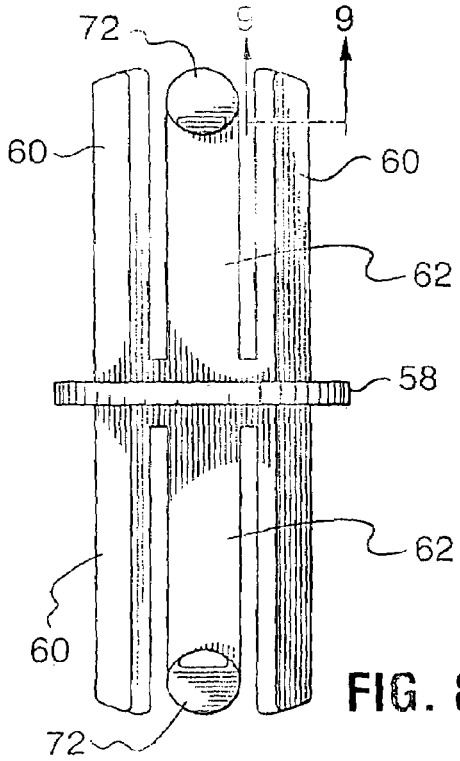
FIG. 8 is an elevation of the connector device along line 8-8 of FIG. 8.

The connector device (56) is shown in FIGS. 7 and 8. The connector device (56) has a median dividing plate (58). A pair of upper and a pair of lower rails (60) extend from the median dividing plate (58). An upper and lower flexible tongue (62) also extend from the median dividing plate (58). Each side of the median dividing plate (58) provides support to a pair of rails (60) and flexible tongue (62) located between the rails (60). One of the rails (60) of the connector device (56) is shown on FIG. 10. Each of the rails (60) of the connector device (56) has a rectangular main body (64). The rectangular body (64) provides support to the extension wall (66). The extension wall (66) is formed by the inner surface extension (68) and outer angled surface extension (70). The two rails (60) of the connector device (56) can freely slide into the rail receiving openings (40) of the tilt control bar (24). Each of the two flexible tongues (62) of the connector device (56) has a cylindrical head (72). Each cylindrical head (72) has a ramp surface (74) down sloping at approximately about 45 degrees from the point that is closer to the median dividing plate (58) to the point that is further from the median dividing plate (58).

Function

The present invention is applicable to joining of two tilt control bars by connector device (56). The connector device (56) enables a person to connect or disconnect two tilt control bars. In this way its possible to adjust the tilt of two or more groups of louvres (18) in a multi-group shutter assembly (10) either each group separately or all groups in unison.

To adjust the tilt of all the louvres (18) in the multi-group shutter assembly (10) in unison, the tilt control bars (24) of the separate groups of the louvres (18) are connected together by the connector device (56). The connector device (56) is removably located in a one of the tilt control bars (24). To connect two tilt control bars (24) of two separate groups of louvres in a multi-group shutter assembly (10), the rails (60) of the connector device (56) are inserted into the rail receiving openings (40) of the tilt control bar (24) of another group of louvres. The rails (60) of the connector device (56) slide in the rail receiving openings (40) of the tilt control bar (24) until the ramp surface of the cylindrical head (72) of the flexible tongue (62) reach the notch (44) and locks in it. The cylindrical head (72) of the flexible tongue (62) serves as a latch. The cylindrical head (72) of the flexible tongue (62) pushes the push-pull finger (48) outward in the finger opening (42) when the cylindrical head (72) locks in the notch (44). The two tilt control bars (24) become connected and able to adjust in unison the tilt of the louvres (18) of the multi-group shutter assembly (10).

To control the tilt of the louvres (18) in the separate groups of the multi-group shutter assembly (10) individually, the tilt control bars (24) of the separate groups of louvres (18) are disconnected. To disconnect the tilt control bars (24), the push-pull finger (48) in the second tilt control bar (24) is pushed inward through the finger opening (42) towards the cylindrical head (72) of the flexible tongue (62) of the connector device (56). The push-pull finger (48) reaches the sloping surface (74) of the cylindrical head (72) of the flexible tongue (62) and deflects the cylindrical head (72) of the flexible tongue (62). The cylindrical head (72) of the flexible tongue (62) leaves the notch (44) and unlocks the connector device (56). The rails (60) of the connecter device (56) are pulled out of the rail receiving openings (40) of the second tilt control bar (24). The two tilt control bars (24) of a multi-group shutter assembly (10) become disconnected. The two tilt control bars (24) become disconnected and able individually adjust the tilt of each group of the louvres (18) of the multi-group shutter assembly (10).

The above is a description of a preferred embodiment of the invention which is given here by way of example only. The invention is not to be taken as limited to any of the specific features as described, but comprehends all such variations thereof as come within the scope of the appended claims.

What is claimed:

1. A shutter assembly having a rectangular frame, consisting of a pair of vertically opposed side rails and a pair of horizontally opposed side rails, and comprising:

at least two separate sections of louvres rotatably supported in the frame, defining at least an upper section and a lower section;

at least two separate tilt control bars, for controlling said at least two separate sections of louvres;

links connecting respective louvres in respective sections to the respective control bar;

a releasable connector device for connecting and disconnecting said tilt control bars of at least two separate sections of louvres of said shutter assembly, to allow adjustment of the tilt of the louvres in all said sections of said shutter assembly in unison when said tilt control bars are connected, and to allow adjustment of each separate section of the louvres individually, when they are disconnected;

wherein said releaseable connector device further comprises an upper flexible tongue releasably interengageable with a first respective said tilt control bar:

a lower flexible tongue, releasably interengageable with a second respective said tilt control bar and, a median dividing plate extending between said upper and lower tongues.

2. The shutter assembly as claimed in claim 1, that further includes pivot pin openings in said vertically opposed side rails.

3. The shutter assembly as claimed in claim 1, that further includes pivot pins at each end of the louvres fitted in the said pivot pin openings of said vertically opposed side rails.

4. The shutter assembly as claimed in claim 1, wherein said tilt control bars further comprises side walls that form the tilt control bar, an arcuate web that connects said side walls;

retention ribs that extend from said side walls;

z-shaped reinforcing walls that extend from said side walls, an intermediate partition wall supported by and extending between said arcuate web and said z-shaped reinforcing walls;

hollow tubular spaces formed by said intermediate partition wall and said ( )-shaped reinforcing walls;

connector device receiving openings formed by said side walls, said z-shaped reinforcing walls and said retention ribs;

a finger opening that perforates said arcuate web and said intermediate partition wall through out from the end that is supported by said arcuate web to the end that is supported by said z-shaped reinforcing walls.

5. The shutter assembly as claimed in claim 4, wherein said tilt control bar further comprises a notch on the end of said finger opening that is supported by said z-shaped walls.

6. The shutter assembly as claimed in claim 4, wherein said tilt control bar further comprises sockets for the said links that connect said tilt control bar and the front edges of said louvres.

7. The shutter assembly as claimed in claim 4, wherein said releasable connector device further comprises a cylindrical head on said flexible tongue; that serves as a latch and locks said connector device in the notch of said finger opening.

8. The shutter assembly as claimed in claim 1, wherein said tilt control bar further comprises a finger opening that perforates and extends through the said intermediate partition wall through out from the end that is supported by the said arcuate web to the end that is supported by the said z-shaped walls, and a push finger slidably received in said finger opening, operable to engage and flex a said tongue.

9. The shutter assembly as claimed in claim 1, wherein said releaseable connector device further comprises a pair of upper and a pair of lower rails supported by said median dividing plate.

10. A shutter assembly having a rectangular frame, consisting of a pair of vertically opposed side rails and a pair of horizontally opposed side rails, and comprising:

at least two separate sections of louvres rotatably supported in the frame;

at least two separate tilt control bars, for controlling at least two separate sections of louvres;

links connecting respective louvres to the respective control bar;

a releasable connector device for connecting and disconnecting the tilt control bars of at least two separate sections of louvres of said shutter assembly, to allow adjustment of the tilt of the louvres in all sections of said shutter assembly in unison, or each separate sections of the louvres individually;

side walls that form said tilt control bar;

an arcuate web that connects said side walls;

retention ribs that extend from said side walls;

z-shaped reinforcing walls that extend from said side walls;

an intermediate partition wall supported by and extending between said arcuate web and said z-shaped reinforcing walls;

hollow tubular spaces formed by said intermediate partition wall and said z-shaped reinforcing walls;

connector device receiving openings formed by said side walls, said z-shaped reinforcing walls and said retention ribs;

a finger opening that perforates said arcuate web and said intermediate partition wall through out from the end that is supported by said arcuate web to the end that is supported by said z-shaped reinforcing walls;

a notch on the end of said finger opening that is supported by said z-shaped walls;

sockets formed in said finger openings for said links that connect said tilt control bar and said louvres.

11. A shutter assembly having a rectangular frame, consisting of a pair of vertically opposed side rails and a pair of horizontally opposed side rails, and comprising:

at least two separate sections of louvres rotatably supported in the frame;

at least two separate tilt control bars, for controlling at least two separate groups of louvres;

links connecting respective louvres to the respective control bar;

a releasable connector device for connecting and disconnecting the tilt control bars of at least two separate sections of louvres of said shutter assembly, to allow adjustment of the tilt of the louvres in all sections of said shutter assembly in unison, or each separate section of the louvres individually;

side walls that form said tilt control bars;

an arcuate web that connects said side walls;

retention ribs that extend from said side walls;

z-shaped reinforcing walls that extend from said side walls;

an intermediate partition wall supported by said arcuate web and said z-shaped reinforcing walls;

hollow tubular spaces formed by said intermediate partition wall and said z-shaped reinforcing walls;

connector device receiving openings formed by said side walls, said z-shaped reinforcing walls and said retention ribs;

a finger opening that perforates said intermediate partition wall through out from the end that is supported by said arcuate web to the end that is supported by said z-shaped reinforcing walls;

a notch on the end of said finger opening that is supported by said z-shaped walls;

sockets for said links that connect said tilt control bar and said louvres;

said releasable connector device in turn comprising:

a median dividing plate of said releasable connector device;

a pair of upper and a pair of lower rails supported by said median dividing plate of said releasable connector device;

an upper and lower flexible tongue supported by said median dividing plate of said releasable connector device;

a cylindrical head of said flexible tongue; that serves as a latch and locks said releaseable connector device in the notch of said finger opening.

* * * * *